US007210603B2

(12) United States Patent
Smith

(10) Patent No.: US 7,210,603 B2
(45) Date of Patent: May 1, 2007

(54) GLOVE INVERTER

(75) Inventor: Gregory John Smith, Oakland, CA (US)

(73) Assignees: Gregory J. Smith, Oakland, CA (US); Galaxi Studio LLC, Oakland, CA (US)

( * ) Notice: Subject to any disclaimer, the term of this patent is extended or adjusted under 35 U.S.C. 154(b) by 278 days.

(21) Appl. No.: 10/790,505

(22) Filed: Mar. 1, 2004

(65) Prior Publication Data

US 2005/0189384 A1 Sep. 1, 2005

(51) Int. Cl.
*A41H 43/00* (2006.01)

(52) U.S. Cl. ..... 223/39; 223/111

(58) Field of Classification Search ..... 223/1, 223/39–42, 111, 78
See application file for complete search history.

(56) References Cited

U.S. PATENT DOCUMENTS

| | | | | | |
|---|---|---|---|---|---|
| 754,539 | A * | 3/1904 | Burr | 223/39 |
| 960,937 | A * | 6/1910 | Imbrie | 223/41 |
| 1,321,944 | A * | 11/1919 | Rieck | 223/39 |
| 1,378,646 | A * | 5/1921 | Baum | 223/40 |
| 1,439,844 | A * | 12/1922 | Scully | 223/41 |
| 1,537,794 | A * | 5/1925 | Baum | 223/40 |
| 1,699,265 | A * | 1/1929 | Ammon | 223/39 |
| 1,735,688 | A * | 11/1929 | Lowry | 223/40 |
| 1,744,859 | A * | 1/1930 | Baum | 223/40 |
| 1,766,502 | A * | 6/1930 | Baum | 223/40 |
| 2,058,065 | A * | 10/1936 | Dersom | 223/41 |
| 2,375,093 | A * | 5/1945 | Fenwick | 223/1 |
| 2,427,933 | A * | 9/1947 | Summers | 223/40 |
| 2,601,504 | A * | 6/1952 | Cripe | 223/40 |
| 2,760,695 | A | 8/1956 | Ketterer | 223/39 |
| 3,516,583 | A * | 6/1970 | Petty | 223/39 |
| 3,637,119 | A * | 1/1972 | Blair | 223/39 |
| 3,643,840 | A | 2/1972 | Le Blanc | 223/42 |
| 3,738,547 | A * | 6/1973 | Horton | 223/40 |
| 3,762,613 | A | 10/1973 | Hardaker | 223/40 |
| 3,785,893 | A | 1/1974 | Rotondi | 156/198 |
| 4,199,089 | A | 4/1980 | Filkow et al. | 223/79 |
| 4,436,231 | A * | 3/1984 | Kelly et al. | 223/40 |
| 4,620,649 | A * | 11/1986 | Graham | 223/40 |
| 4,749,111 | A | 6/1988 | Hardwick | 223/42 |
| 5,392,970 | A | 2/1995 | Orosei | 223/39 |
| 5,799,842 | A | 9/1998 | Rumsey | 223/1 |
| 6,279,792 | B1 * | 8/2001 | Neal | 223/111 |
| 6,568,572 | B1 * | 5/2003 | Smith | 223/42 |

* cited by examiner

*Primary Examiner*—Gary Welch
*Assistant Examiner*—Andrew W. Sutton

(57) ABSTRACT

The present invention is a device that provides a trouble free method to invert glove appendages expeditiously; especially but not exclusively, industrial, heavy duty, lined, rubber gloves; to facilitate efficient cleaning and subsequent rapid drying of the lining, which consists of a base that has an opening and a pushrod that fits into the opening in the base to be securely mounted therein, wherein the exposed concave tip of the pushrod engages the tip of the glove appendage and insures continuous engagement thereof while the glove is peeled down over the pushrod, thereby accomplishing complete inversion of the glove appendage further providing means to promote and maintain healthy morbidity free hands.

1 Claim, 2 Drawing Sheets

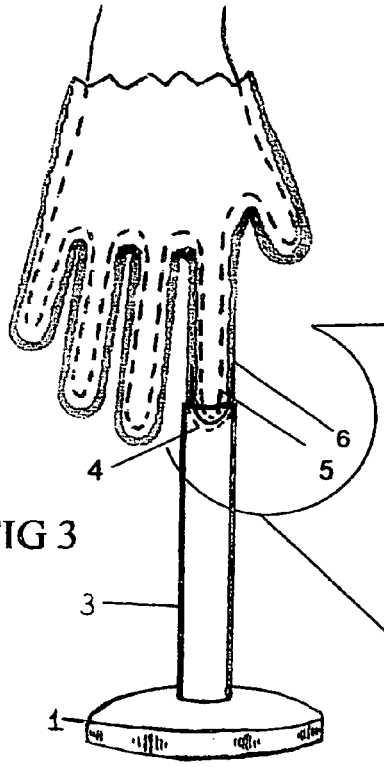
FIG 3
FIG 4
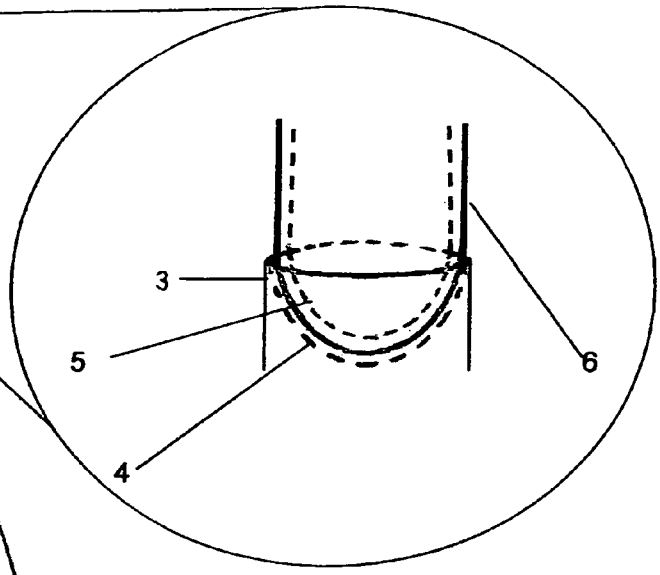
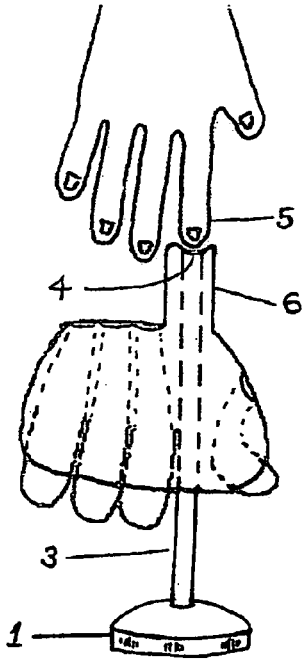
FIG 5

GLOVE INVERTER

FEDERALLY SPONSORED RESEARCH

Not Applicable

SEQUENCE LISTING OR PROGRAM

Not Applicable

BACKGROUND—INCEPTION OF INVENTION

The inception of this invention arose from my personal experience in the Pearl and Construction industry in Japan. I spent too much of my break time turning rubber gloves inside out by hand to clean and dry them. I discontinued this practice because it was too frustrating and time consuming, and as a result, I began to have serious health problems with my hands including redness, itching, chaffing, etc. not to mention the stress accompanying such discomfort I searched for a device to invert rubber gloves at numerous outlets that cater to industries utilizing industrial, heavy duty, lined, rubber gloves; but to no avail.

1. Technical Field

The present invention relates to a device that eliminates maladies of the hands typically associated with the use of substantially thick gloves. This invention is used for inverting glove appendages. Well suited but not limited to industrial, heavy duty, lined, rubber gloves it can also be applied to any thick material glove. Moreover, this invention facilitates the expeditious inversion and subsequent efficient cleaning and/or rapid drying of the lining of the gloves, thereby providing a means to maintain healthy morbidity free hands.

Perspiration soaked, lined rubber gloves are extremely difficult and frustrating and time consuming to invert by hand for efficient cleaning and/or rapid drying of the lining. Also the bacteria and fungus that thrive and multiply in moist, unsanitary rubber gloves precipitates a plethora of health complications ranging from mere discomfort due to itching, chaffing, sore hands, to more severe ailments including fungal infections associated with improper sanitation and desiccation; not to mention the stress, the reduction in concentration, diminished efficiency and lower productivity associated thereof.

2. Prior Art

I would like to urge the reader to consider this as a brand new field per se. The present invention deals with a specific field of inversion that is notably absent in development. Most prior art in the field of inversion deals with tools to assist in the manufacture of products. Others deal with oblong finished products such as belts, ties, stockings etc. The present invention deals with gloves as finished products, the purpose of which is to provide a means to maintain healthy morbidity free hands for the users of a variety of thick material gloves.

Fabric inversion of all kinds have employed the use of numerous and varied tools. U.S. Pat. No. 4,749,111 by Hardwick appears similar in structure to the present invention, however there are significant differences, especially the technique employed to invert a fabric and the field of application is dissimilar.

U.S. Pat. No. 6,568,572 to Smith is quite similar to the present invention on the surface. Even though it performs the same function as the present invention, it consists of 3 components and requires twice as many steps and requires at least twice as much time to perform the function of inverting glove appendages. Moreover it incurs an added expense to manufacture an additional component. Therefore the need exists for an improvement in the field that costs less to manufacture and is more efficient and requires less time to perform the function of inverting glove appendages. Also the present invention is lighter and more compact.

Furthermore there are significant improvements the present invention provides. The new technology of the present invention is practically unnoticeable. Precisely, the configured tip of the guide provides a means to insure continuous engagement with the tip of the glove appendages, thereby increasing efficiency and reducing the time necessary to perform the function of inverting glove appendages.

Moreover, the technique is dissimilar. U.S. Pat. No. 6,568,572 employs a method of insertion: insert the tube into the glove appendage socket; subsequently insert the pushrod into the tube to invert the appendage. Whereas the present invention utilizes a technology based upon a guiding principal, wherein the configuration of the tip of the guide provides a means to insure continuous engagement of the tip of the glove appendage thereby resulting in complete inversion by virtue of a definitive guidance procedure.

OBJECTS AND ADVANTAGES

The purpose of the present invention is to promote a healthy, morbidity free environment in relation to the hands in the workplace and at home by offering an expeditious and trouble free procedure and instrument for inverting glove appendages, thereby facilitating efficient cleaning and/or rapid drying of the lining, thus providing a means to maintain healthy morbidity free hands.

It is accordingly one object of the present invention to provide a procedure and instrument to invert glove appendages that is easy to use.

It is another object of the present invention to provide a procedure and instrument to invert glove appendages that eliminates the frustration and difficulty altogether of inverting glove appendages by hand.

Another object of the present invention is to provide a time saving procedure and instrument to invert glove appendages.

A further object of the present invention is to provide a procedure and instrument to invert glove appendages that facilitates efficient cleaning and prompt drying of the lining.

A further object of the present invention is to provide a procedure and instrument to invert glove appendages that is durable and easy to manufacture.

An even further object of the present invention is to provide a procedure and instrument to invert glove appendages that is extremely inexpensive to produce.

An even further object of the present invention is to provide a procedure and instrument to invert glove appendages that can be used on a variety of gloves and glove sizes.

An even further object of the present invention is to provide a procedure and instrument to invert glove appendages that is detachable thus making it portable.

Finally, it is the main objective of the present invention to provide a device to invert glove appendages that provides a means to eliminate maladies of the hands typically associated with the use of substantially thick material gloves and to promote and maintain healthy morbidity free hands.

SUMMARY

In accordance with the present invention, my glove inverter comprises a base and a pushrod. This is a device for inverting glove appendages expeditiously; especially but not exclusively, industrial-heavy duty-lined-rubber gloves; thereby facilitating efficient cleaning and rapid drying of the lining. The present invention promotes healthy, morbidity free hands in the workplace and at home.

BRIEF DESCRIPTION OF VIEWS

The present invention will be described hereafter with reference to the attached drawings that are given as non-limiting examples only, in which:

FIG. 3 illustrates the initial procedure of the present invention.

Figure 1:
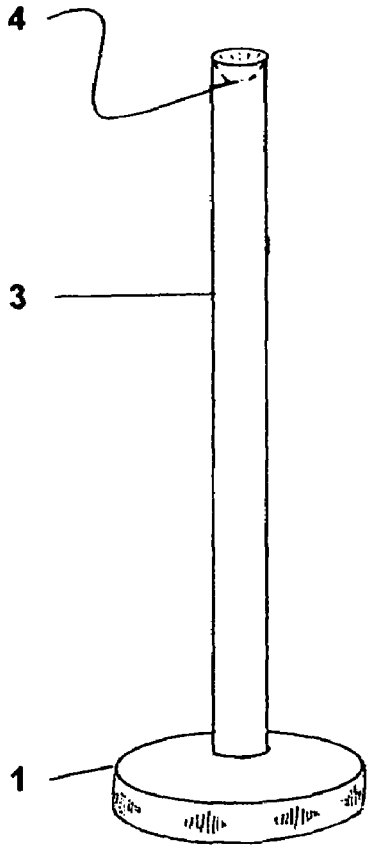
FIG. 1 is a frontal view of the instrument according to one embodiment of the present invention.
Figure 2:
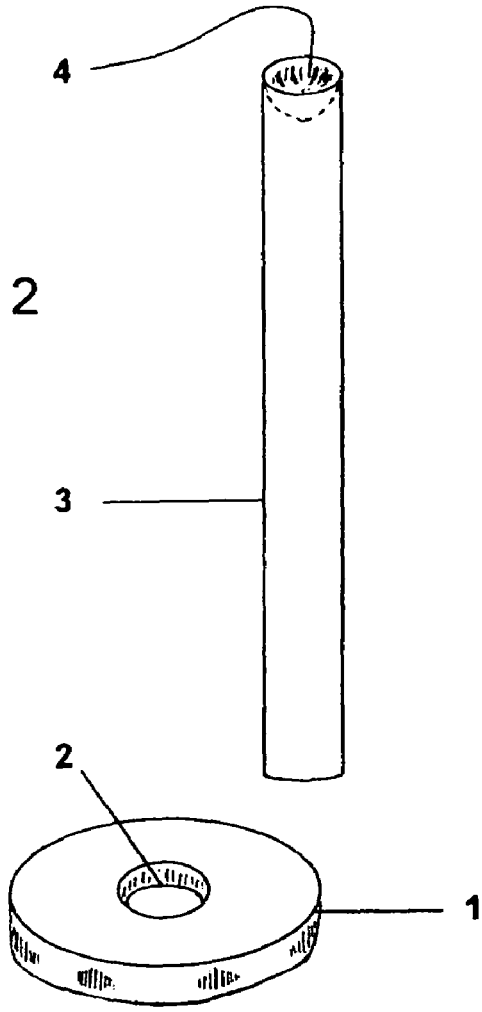
FIG. 2 is a view of the separate components of the instrument shown in FIG. 1 at a slight angle from above.

FIG. 4 highlights a magnified view of the innovation the present invention provides; specifically the unobvious configuration of the exposed tip of the device.

FIG. 5 shows the end result of the method; a guidance principal; that manifests the glove appendage completely inverted.

DETAILED DESCRIPTION

Further characteristics and advantages according to the present invention will become apparent from the following detailed description of a preferred but not exclusive embodiment thereof.

The procedure and instrument of the present invention eliminates maladies of the hands typically associated with the use of substantially thick gloves. It is well suited for, but not limited to industrial, heavy duty, lined, rubber-gloves. It can also be applied to any thick material glove, such as ski gloves, leather gloves, multi-layered gloves etc.

The present invention allows for the trouble free and expeditious inversion of glove appendages thereby facilitating efficient cleaning and subsequent rapid drying of the lining.

The present invention consists of a positioner (1) that has an orifice (2) with dimensions sufficient to receive and stabilize a guide (3) and the guide (3), having opposing ends of likely similar configurations; both ends configured to allow for the introduction of the tip of glove appendages and provide a means for placement into the orifice (2), thereby providing a means for reciprocity. When assembled the exposed configured end (4) provides a means to insure continuous engagement of the tip of the glove appendages.

The base (1) can be a small-semi-circular-oval shape that fits comfortably in the palm of a hand. The pushrod (3) can be cylindrical and of a diameter that fits into the opening (2) in the base (1) and of a diameter sufficient to receive a glove appendage and a length sufficient to invert the glove appendage without hindrance or interference. The concave tip (4) of the pushrod (3) provides a means to insure continuous engagement of the tip of the glove appendage. Any material, rigid or flexible that is capable of withstanding the pressure necessary to perform the function of the present invention without fracturing or otherwise rendering it inoperable and can be molded, shaped, cut, cast, manufactured, etc. in the configuration according to the invention can be employed in the construction thereof.

With reference to one preferred non limiting configuration according to the present invention the positioner could be constructed of plastic; having a circular shape with a diameter of approximately 3" and an orifice in the center with a height and diameter of about ½" and 9/16" respectively. The exterior of the positioner would have a natural tapered curvature extending from the crest of the perimeter of the orifice wall (app. 1/16") to the perimeter of the positioner, a point ⅛" from the nadir; both edges to be rounded for safety in handling. The underside could be semi hollow, having 3 or more oblong triangular buttresses to provide structural integrity. The guide is of a length that will accommodate a standard glove appendage. One preferred embodiment would be a standard 9/16" dowel approximately 10" in length. Having two opposing ends of practically the same configurations allows for the ends to be used interchangeably thus further providing convenience and speed of application. The ends would preferably be a concave depression of about 3/16" deep thus providing a means to introduce and insure continuous engagement of the tip of glove appendages.

Operation

The operation of the present invention is set forth as follows: place the guide (3) into the orifice (2) in the positioner (1). In the process of taking the glove off, invert it as much as possible. Engage the tip of the glove appendage with the configured end (4) of the guide (3). Use the finger inside the glove appendage to maintain continuous contact with the configured end (4) of the guide (3) as you peel the glove down over the guide (3) until complete inversion of the glove appendage is accomplished. Repeat the same procedure for the remaining appendages and to return the glove back to the proper side.

Conclusions, Ramifications, and Scope

Accordingly, you can see that the present invention eliminates the difficulty and frustration of inverting glove appendages by hand altogether and dramatically reduces the time necessary to perform the function of inverting glove appendages. Furthermore, the present invention can be applied much easier, considerably faster and more effectively than by hand. Further still, complete inversion of glove appendages is accomplished expeditiously thereby facilitating efficient cleaning and rapid drying of the lining. Even further, the present invention provides a highly reliable, lightweight, detachable, portable, yet economical device that can be applied by persons of almost any age almost anywhere. Moreover, use of the present invention ameliorates the condition of the hands by providing a healthy, morbidity free environment thus eliminating stress which affects concentration which affects efficiency which affects productivity in the workplace or at home.

Although the detailed description above contains specificities, these should not be construed as limitations on the scope of the invention, but rather as an exemplification of one preferred embodiment thereof. Other variations are possible. For example, the size can vary, the shape can vary, the colors are variable, the material employed to construct the instrument can be any material; natural, artificial, composite, etc. Furthermore, all of the components of the present invention can be made from any material(s) that can be rigid or flexible, but capable of withstanding the pressure necessary to perform the function for which it is designed without fracturing or otherwise rendering the instrument inoperable. Moreover, this instrument can be used with or without the positioner. Additionally the present invention has been more than reduced to practice, it has been extensively tested and proven to operate flawlessly and as a result of the improved technology, this novel instrument performs the function for which it was designed much more efficiently and faster than any prior art in the field.

What is claimed:

1. A method that inverts a glove for promoting healthy morbidity free hands, including an apparatus consisting of:

a base having an opening with a depth sufficient to receive and stabilize a pushrod, a longitudinally extending pushrod having a first end and a second end, the first end received into the opening of said base and said second end having a concave tip for receiving a fingertip of a user's finger, wherein the glove is inverted by placing a tip of a finger on a gloved hand onto said concave tip, peeling the glove down over said pushrod while maintaining continuous contact of the pushrod until glove is fully inverted and removed from hand.

* * * * *